US009279263B2

(12) United States Patent
McFarland

(10) Patent No.: US 9,279,263 B2
(45) **Date of Patent: *Mar. 8, 2016**

(54) SEQUENCED CHAMBER WAVE GENERATOR APPARATUS AND METHOD

(76) Inventor: Bruce McFarland, Solana Beach, CA (US)

( * ) Notice: Subject to any disclaimer, the term of this patent is extended or adjusted under 35 U.S.C. 154(b) by 827 days.

This patent is subject to a terminal disclaimer.

(21) Appl. No.: 13/603,223

(22) Filed: Sep. 4, 2012

(65) Prior Publication Data

US 2013/0227777 A1 Sep. 5, 2013

Related U.S. Application Data

(63) Continuation-in-part of application No. 13/411,520, filed on Mar. 3, 2012, now Pat. No. 8,434,966.

(51) Int. Cl.
*A47K 3/10* (2006.01)
*E04H 4/00* (2006.01)

(52) U.S. Cl.
CPC ..... *E04H 4/0006* (2013.01)

(58) Field of Classification Search
CPC ..... E04H 4/0006
USPC ..... 4/491
See application file for complete search history.

(56) References Cited

U.S. PATENT DOCUMENTS 2,406,413 A 8/1946 Test
3,105,456 A 10/1963 Gongwer
3,350,724 A 11/1967 Leigh
3,473,334 A 10/1969 Dexter
3,577,570 A 5/1971 Vincent
3,629,877 A * 12/1971 Schuster ..... E04H 4/0006 4/491
4,062,192 A 12/1977 Blewer
4,276,664 A 7/1981 Baker
4,467,483 A 8/1984 Bastenhof
4,515,500 A 5/1985 Bastenhof
4,522,535 A 6/1985 Bastenhof
4,558,474 A 12/1985 Bastenhof
4,692,949 A 9/1987 Dunn
4,730,355 A 3/1988 Kjreinbih et al.
4,730,807 A 3/1988 Miller
4,812,077 A 3/1989 Raike
4,979,244 A 12/1990 Bastenhof (Continued)

FOREIGN PATENT DOCUMENTS

JP 05-202626 8/1993

OTHER PUBLICATIONS

Untitled regarding "Ocean Dome".

*Primary Examiner* — Huyen Le
(74) *Attorney, Agent, or Firm* — Manuel de la Cerra

(57) ABSTRACT

A wave generating apparatus and method is provided in which a controller actuates a plurality of wave generating chambers in sequence using a delay between actuation of each chamber to produce a rideable wave in a pool. The actuation delay period may be a predetermined proportion of the chamber period. The sequence creates a surging motion in the pool that changes the characteristics of the waves to create a considerably hollow barreling wave. The flow of water created by a sequence may resemble a diamond pattern and additional patterns may resemble diamonds linked at the vertices. This pattern effectively reduces the depth of the water between successive waves, which causes them to pitch away from the chambers and create a considerably hollow barrel.

19 Claims, 5 Drawing Sheets

(56) References Cited

U.S. PATENT DOCUMENTS

| | | | |
|---|---|---|---|
| 4,999,860 | A | 3/1991 | Chutter et al. |
| 5,098,222 | A | 3/1992 | Robinson |
| 5,186,578 | A | 2/1993 | Perslow |
| RE34,407 | E | 10/1993 | Frenzl |
| 5,342,145 | A | 8/1994 | Cohen |
| 5,405,250 | A | 4/1995 | Vowles |
| 5,535,702 | A | 7/1996 | Idbeis |
| 5,621,925 | A | 4/1997 | Batenhof |
| 6,475,095 | B1 | 11/2002 | Henry |
| 6,729,799 | B1 | 5/2004 | Raike |
| 6,738,992 | B2 | 5/2004 | Lochtefeld |
| 6,912,738 | B2 | 7/2005 | Black |
| 6,920,651 | B2 | 7/2005 | Roberts |
| 7,666,104 | B2 | 2/2010 | Lochtefeld |
| 7,815,396 | B2 | 10/2010 | McFarland |
| 8,434,966 | B1 * | 5/2013 | McFarland ..... E04H 4/0006 4/491 |

* cited by examiner

SEQUENCED CHAMBER WAVE GENERATOR APPARATUS AND METHOD

CROSS-REFERENCE TO RELATED APPLICATION

This application claims priority as a continuation-in-part of U.S. patent application Ser. No. 13/411,520 entitled "SEQUENCED CHAMBER WAVE GENERATOR APPARATUS AND METHOD" filed Mar. 3, 2012 by Bruce McFarland, which patent application is incorporated herein in its entirety.

TECHNICAL FIELD

The present application relates to wave generators, such as, for example, wave generators for making waves in pools for recreational purposes.

BACKGROUND

Wave generators are often used for recreational purposes. Wave generators create one or more waves in a pool or the like, and people typically either play in the waves or use the waves for aquatic sports such as board sports. Aquatic board sports, such as surfing and bodyboarding, require that the waves be rideable. Enthusiasts in these types of sports often use wave generators for competition, practice and entertainment.

Existing wave generators typically use wave generating chambers to produce a wave that travels in a direction where the peak of the wave is substantially parallel to the chambers and the beach as it travels from the chambers toward the beach to the wave generating apparatus, and the wave is produced when the wave generating chambers (either one chamber or multiple chambers) are all activated simultaneously, resulting in the water being pushed away from the wave generating chambers, which then travels at an angle away from the chambers. The wave then travels away from the chamber until it reaches the opposite end of the pool, breaking at some point between the wave generating chamber and the opposite end of the pool. The waves that are created from these chambers, however, always require single or multiple chambers to actuate simultaneously in unison. The waves can only be ridden for only a short period of time and distance because after the wave is created, it begins to decrease in amplitude and quickly becomes unrideable. Japan App. No. 04-037314 (JPO Publication No. 05-202626) discloses a pool that produce waves that travel in a perpendicular direction from one side toward the other side of the pool. The side walls of the pool are in a fan shape to allow persons to ride the wave longer and avoid hitting the wall. This apparatus, however, only produces single waves that travel perpendicularly away from generating apparatus until the wave reaches the opposite end of the pool, and does not teach sequencing. That apparatus attempts to provide for a longer ride on the wave by simply angling the walls in a fan shape, but does not compensate for the wave losing amplitude and strength.

The ring wave type of pool (U.S. Pat. No. 6,920,651) discloses an annular or "doughnut" shaped pool that contains wave generating paddles on the outer wall of the pool that push the water radially inward, from a deep outer diameter region to a shallow inner diameter region. The paddles actuate in a synchronous manner, one after the other, causing the water to circulate around the annulus. This synchronized pushing of the water inward toward a shallow region would create a small, ever-turning wave that follows the circular path of the pool. The waves would be small because paddles, as shown in FIGS. 2 and 3, could not displace a large, fast-moving and directed flow of water. The paddles essentially create minor, slow-moving displacements of the circulating water, leading to small waves at the shoreline, somewhat like the wake of a boat hitting the shore of a river or lake. The angle of the waves to the shoreline would be largely dictated by the geometry of the structure. Specifically, the waves would necessarily follow the "pinwheel" shape shown therein in FIG. 1; waves could not be created with different breaking characteristics. Additionally, the waves would always be arc-shaped, not substantially straight-lines like most naturally occurring waves in the ocean. Also, the waves do not break and become rideable until they are a far distance from the wave generating paddle because the wave cannot break until it reaches the breakpoint on the floor of the pool, which is the peak of a long inclined slope on the floor of the pool. Therefore, this apparatus is extremely large with a significant portion of the water surface having no rideable wave. Indeed, users would be in danger if they did not stay close to shore, because they could be seriously injured by the paddles. In fact, if a user could not swim or for some reason sank to the bottom, they would tend to slide down the slope straight into the moving paddle. In sum, constructing and maintaining such an apparatus would be extremely expensive, with only small, non-realistic waves produced near the shore, all while presenting a serious risk of injury to users.

What is needed is an apparatus that overcomes the shortcomings of the prior art, including providing a rideable wave that pitches closer to the beach end of the pool.

SUMMARY

Provided is a new and improved wave generator apparatus and method that in various example embodiments may include sequenced chambers adapted to create a rideable wave that changes the breaking characteristics of a wave by creating a surging motion in the pool that causes the wave to pitch further out into the pool, creating a more hollow barrel. In one example embodiment, a wave generating apparatus has a pool that holds water, the pool having a first end, second end, two sides, and a floor. The first end of the pool may contain a plurality of wave generating chambers. A controller may be connected to the chambers. The controller operation may actuate the first chamber or first set of chambers in the plurality to release water into the pool. After a delay, the controller may actuate the second chamber or second set of chambers to release water into the pool, and after a delay, the controller may actuate a third chamber or third set of chambers to release water into the pool. This sequence may continue and repeat with each chamber or set of chambers. The wave generator apparatus creates waves where the peak of the wave that travels in a direction where the peak of the wave is substantially parallel to the chambers and the beach as it travels from the chambers toward the beach.

In various example embodiments the delay between the actuation of the chambers or set of chambers may be about a chamber period. The delay can be adjusted to modify the travel direction and the amplitude of the wave peak.

Other aspects of the invention are disclosed herein as discussed in the following Drawings and Detailed Description.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views. It may be understood that certain components and details may not appear in the figures to assist in more clearly describing the invention.

DETAILED DESCRIPTION

Following is a non-limiting written description of example embodiments illustrating various aspects of the invention. These examples are provided to enable a person of ordinary skill in the art to practice the full scope of the invention without having to engage in an undue amount of experimentation. As may be apparent to persons skilled in the art, further modifications and adaptations can be made without departing from the spirit and scope of the invention, which is limited only by the claims.

The apparatus disclosed herein in various example embodiments provides a sequenced-chamber wave-generating apparatus that may be adapted for use with aquatic board sports or any other suitable purpose, such as miniature modeling of wave formations. The apparatus overcomes the deficiencies in the prior art by creating a surging motion in the pool that changes the characteristics of the waves to create a considerably hollow barreling wave. The flow of water created by the presently-disclosed sequencing can resemble a diamond pattern and additional patterns such as diamonds linked at the vertices. These patterns effectively reduce the depth of the water between successive waves, which causes them to pitch away from the chambers and create a considerably hollow barrel.

Figure 1:
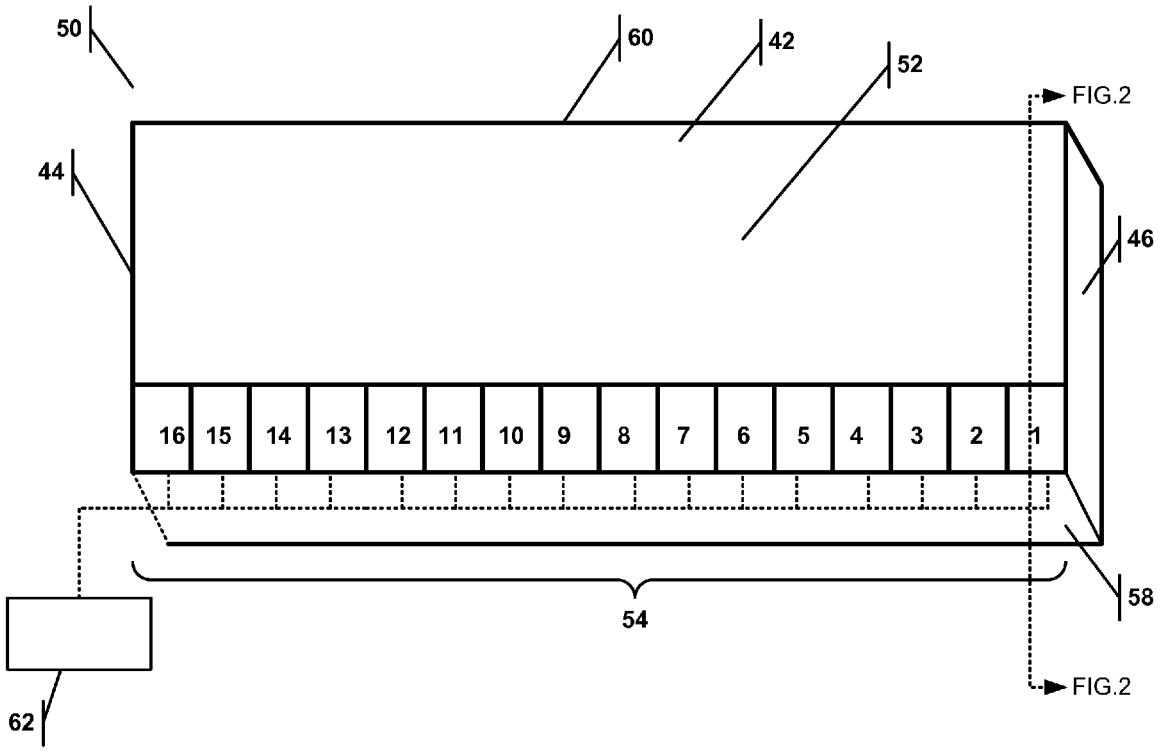
FIG. 1 is a top view of one example embodiment of a wave generator apparatus in a wave pool with sixteen chambers.

FIG. 1 illustrates an example embodiment of a wave generator apparatus, which comprises a pool or container 50, a body of water 52, a plurality of wave generating chambers 54 (each chamber is individually numbered 1-16), and a controller 62 to operate the chambers 54. In this example embodiment, there are sixteen wave generating chambers 54. Although there is no specifically required number of wave generating chambers 54 (other example embodiments include twenty-four and thirty-two chambers, for instance), too few chambers 54 in the apparatus may not be able to produce sufficient resolution to create a wave that can be ridden. In one example embodiment, each chamber is 10 feet by 5 feet by 3 feet, giving each chamber a capacity of 150 cubic feet. Other example embodiments may have wave generating chambers as big as 260 cubic feet or more. It would be apparent to those skilled in the art to modify the size and water displacement of the chambers as needed for specific applications.

The pool 50 may be rectangular shaped and holds the body of water 52. The pool 50 has a first end 58, a second end 60, two sides 44, 46, and a floor 36. The first end 58 is comprised of a plurality of chambers 54 adjacent to one another and the second end 60 is at the opposite end of the pool where the beach 42 is located. The two sides 44, 46 are at opposite ends of the pool 50. The first end 58, second end 60, and two sides 44, 46 act as walls for to pool 50 to contain the body of water 52 along with the floor 36 that is under the body of water 52. The body of water 52 rests in the pool 50 and may be in a still state until the chambers 54 begin to actuate in sequence and create a wave using the body of water 52 in the pool 50.

Figure 2:
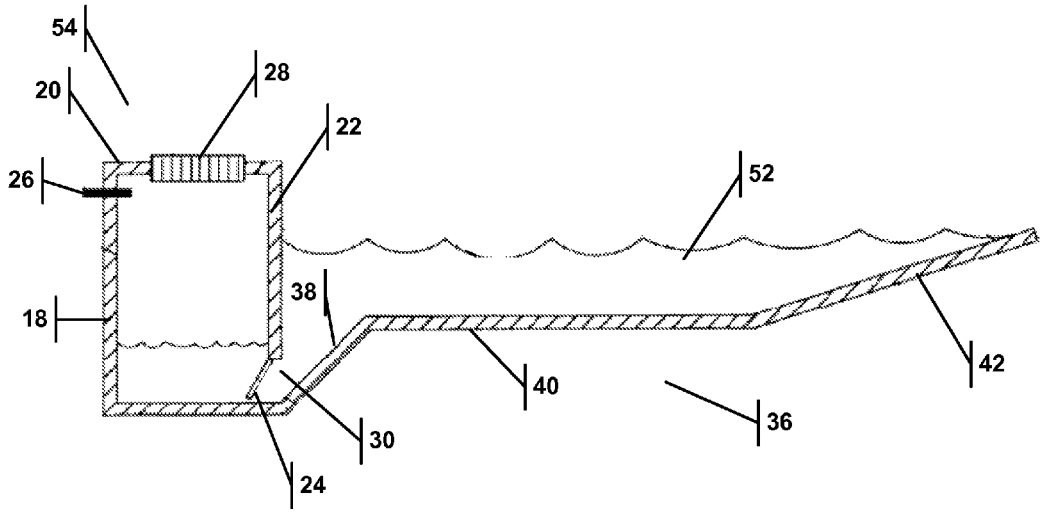
FIG. 2 is a cross-section of FIG. 1, illustrating one example embodiment of a wave generating chamber in a wave pool.

FIG. 2 illustrates an example embodiment of a single wave generating chamber 54, which can comprise a chamber space 56 having a back wall 18, an upper wall 20, and a reflecting wall 22 at the rear wall of the pool that faces the body of water 52 in the pool 50. An example may be that of U.S. Pat. No. 7,815,396 to McFarland, the same inventor of the present application, and the contents of that patent are incorporated herein by reference. A passageway 30 at the lower end of wall 22 allows communication of water between the chamber 54 and the body of water 52 in the pool. A mechanical two-way valve 24 may be located in passageway 30.

The chambers 54 may be connected to an air supply through inlet valve 26 located close to the upper end of the chamber back wall 18 and is also connected to a vent valve 28 in the upper wall 32, which may be connected to a vacuum pump. The floor 36 of the pool may have a first, upwardly inclined portion 38 extending from passageway 30 away from the wave reflecting wall 22, a generally flat portion 40, and an upwardly inclined portion or beach 42 at the opposite, second end 60 of the pool 50.

In operation of this example embodiment, the chamber 54 is first filled with air through valve 26, thereby displacing water into the pool 50. Valve 26 is then closed and the chamber air is vented suddenly through vent valve 28, causing the water 52 to flow from the pool 50 through passageway 30 into the now empty space 56 in the chamber 54. The water level in the pool 50 drops suddenly, creating a depression or trough in the water 52 that reflects against the back or wave reflecting wall 22 of the pool 50. This creates a circulating motion of the water 52, which is enhanced by the design of the back wall 22. The vent valve 28 in the air chamber is shut at the proper time to prevent immediate water resurgence back into the pool 50, which enhances the second trough behind the peak. The mechanical two-way valve 24 can also be used to prevent immediate resurgence. The water valve 24 may be closed during the initial air fill phase to create a larger air volume in the chamber 54 which, when released, creates a larger depression in the pool. Alternatively, air valve 26 can rapidly supply pressurized air to the chamber after the chamber is filled with water to push water out and amplify the wave peak. This process of pushing water out of the chamber and into the pool is known as releasing water. Alternatively, vent valve 28 may be connected to a vacuum source such as a vacuum pump, or may be a vent outlet connected via suitable valving either to atmosphere or to a vacuum source.

Figure 2A:
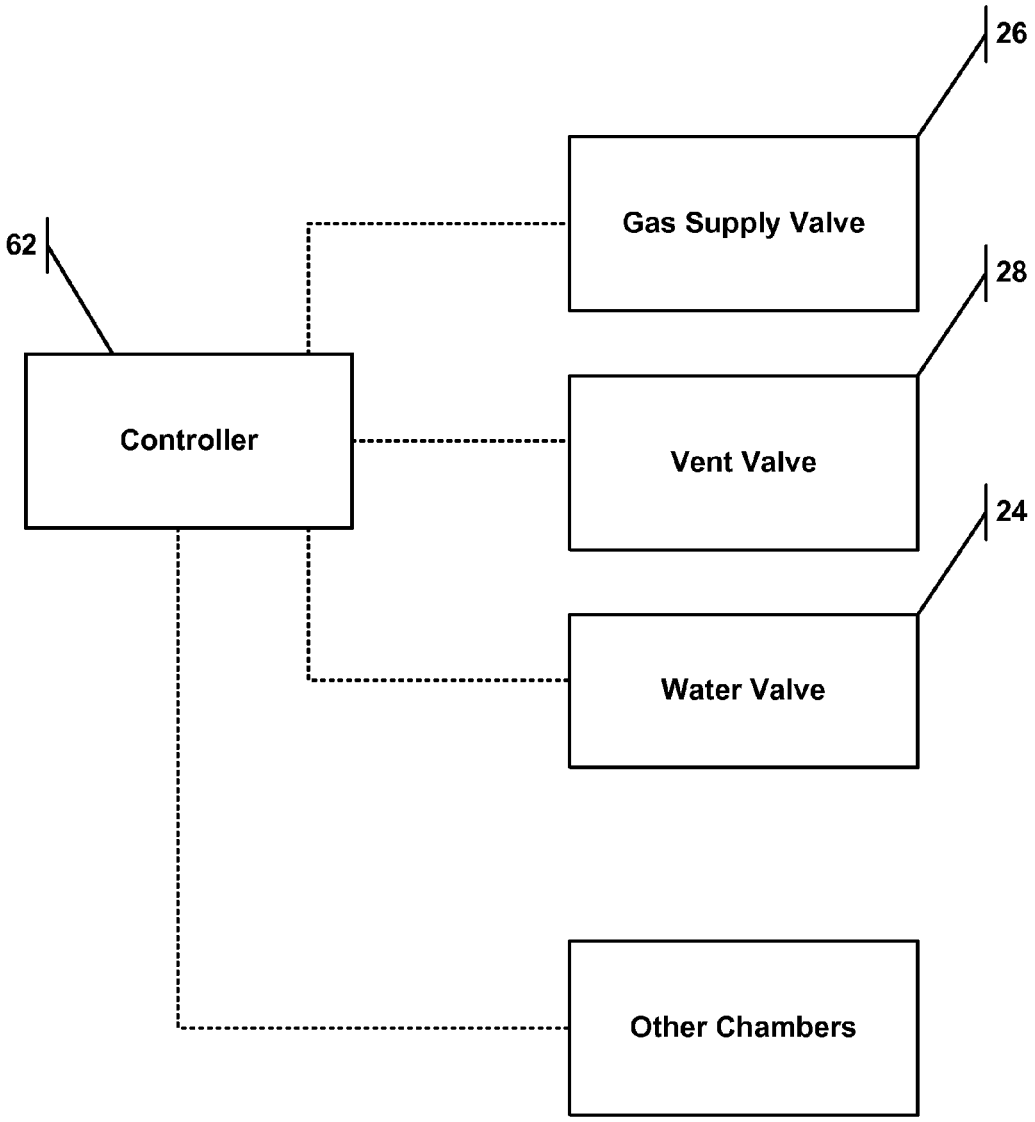
FIG. 2A is a schematic block diagram of a control system for controlling operation of the sequencing of delay between actuating each chamber in the apparatus in FIGS. 1-2.
Figure 3:
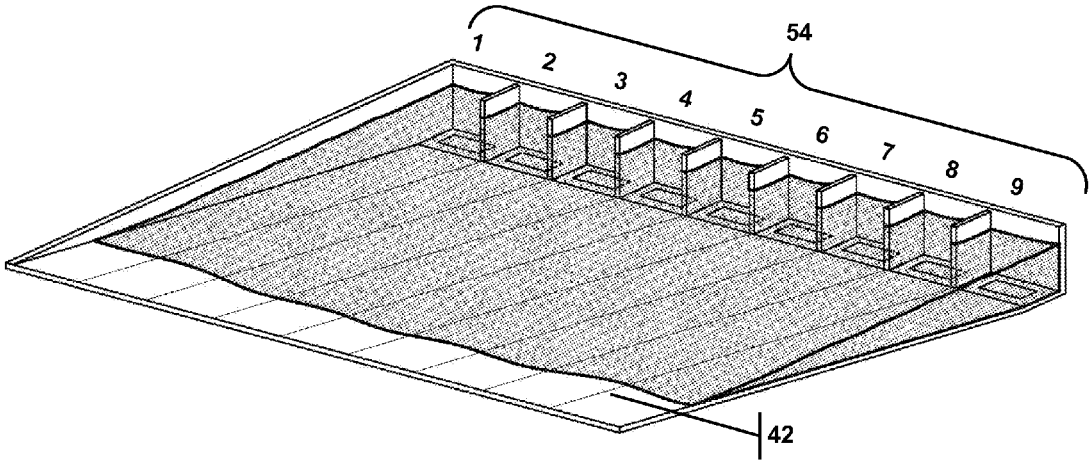
FIG. 3 is a top view of one example embodiment of a wave generator apparatus in a wave pool before any of the chambers have been actuated.

As illustrated schematically in FIG. 2A, the electronic controller 62 may be electrically connected with the valves 26, 28 and 24 in order to control the operation in the manner described above. The controller 62 may control this operation for each chamber, such that the controller 62 actuates each of the chambers in sequence. The controller 62 may begin by actuating the first chamber or the first set of chambers in the plurality. After a predetermined delay, the controller 62 actuates the second chamber or second set of chambers in the plurality, and, after another predetermined delay, actuates the third chamber or third set of chambers in the plurality. This may continue for a fourth chamber or fourth set of chambers, or any number of additional chambers or set of chambers. The controller 62 continues actuating each chamber in the plurality after a delay. FIG. 2A illustrates that the controller 62 controls the valves in each chamber so that after actuating the first chamber or first set of chambers, it can control the valves in that chamber or set of chambers and, after a delay, actuate the second chamber or second set of chambers and control its valves. The controller 62 can actuate each chamber in sequence after a delay and control the valves.

The wave generator apparatus has the ability to create waves where the peak of the wave travels in a direction where the peak of the wave is substantially parallel to the chambers 54 and the beach 42 as it travels from the chambers 54 toward the beach 42. The peak of the wave is defined as the highest water level in the pool. The direction the peak travels is the path that the peak of the wave flows during the life of the wave.

To create the wave, the controller 62 may actuate the chambers 54 in a sequence with a delay between actuating each chamber or set of chambers 54, as described above. The delay is approximately a fraction of the chamber period. In the present example embodiment, as seen in FIGS. 3-6, nine chambers 1-9 are used to produce a wave that can be ridden where the peak of the wave is substantially parallel to the chambers 54 and the beach 42 as it travels from the chambers 54 toward the beach 42.

Figure 7:
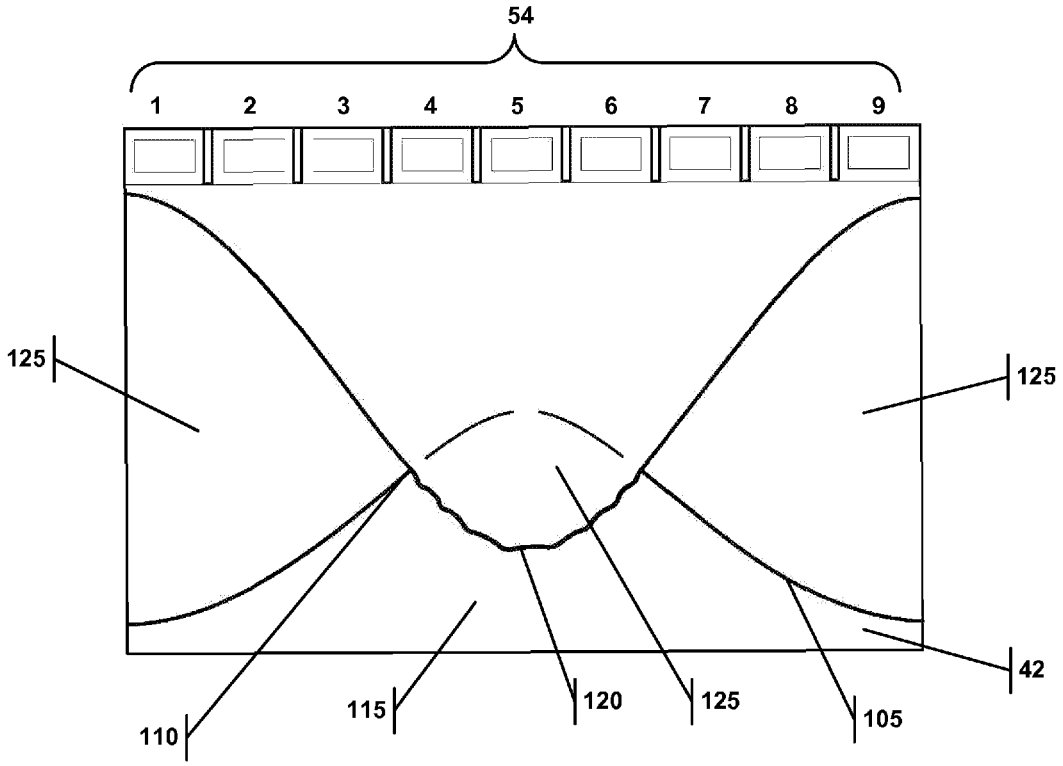
FIG. 7 is a top view of one example embodiment of a wave generator apparatus in a wave pool showing the diamond pattern created during the sequence with the diamond patterns linked at the vertices.

The wave is created by a surging motion in the pool 50 that changes the characteristics of the waves to create a considerably hollow barreling wave. As seen in FIG. 7, the flow of water created by the sequence resembles a diamond pattern and additional patterns would resemble diamonds linked at the vertices. This pattern effectively reduces the depth of the water in the pool 50 between successive waves, which cause the waves to pitch away from the chambers and create a considerably hollow barrel, as seen in FIG. 8.

Figure 4:
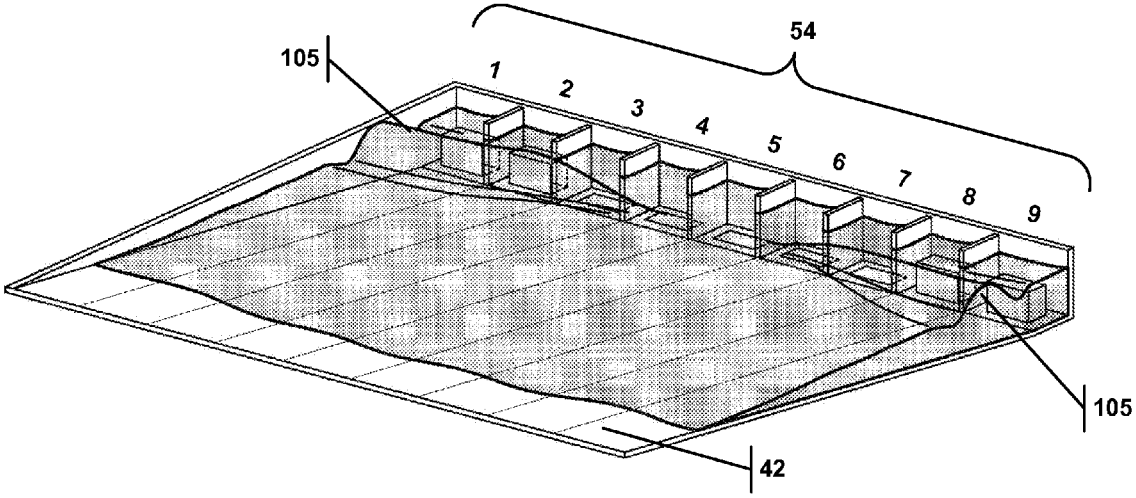
FIGS. 4-6 are top views of one example embodiment of a wave generator apparatus in a wave pool showing the chambers being actuated in sequence to generate waves.
Figure 5:
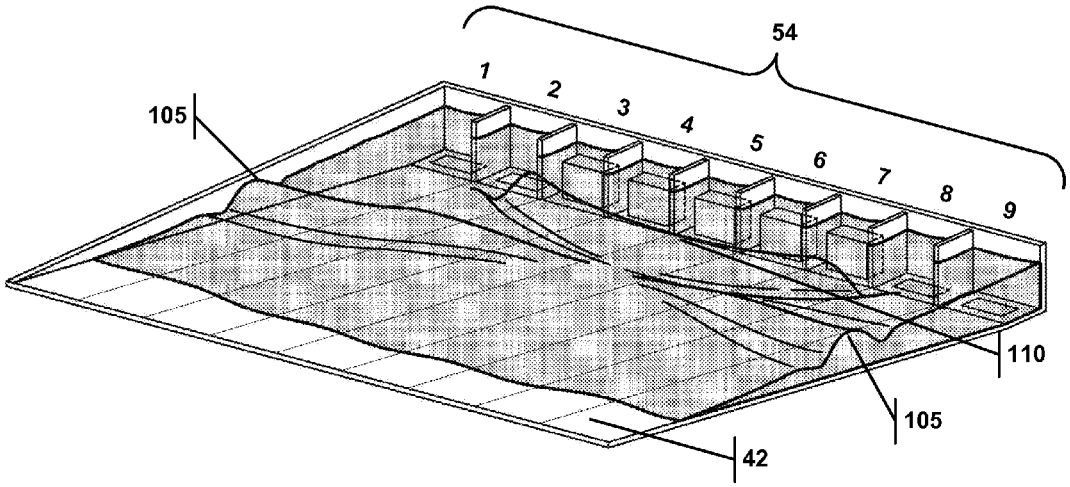
Figure 6:
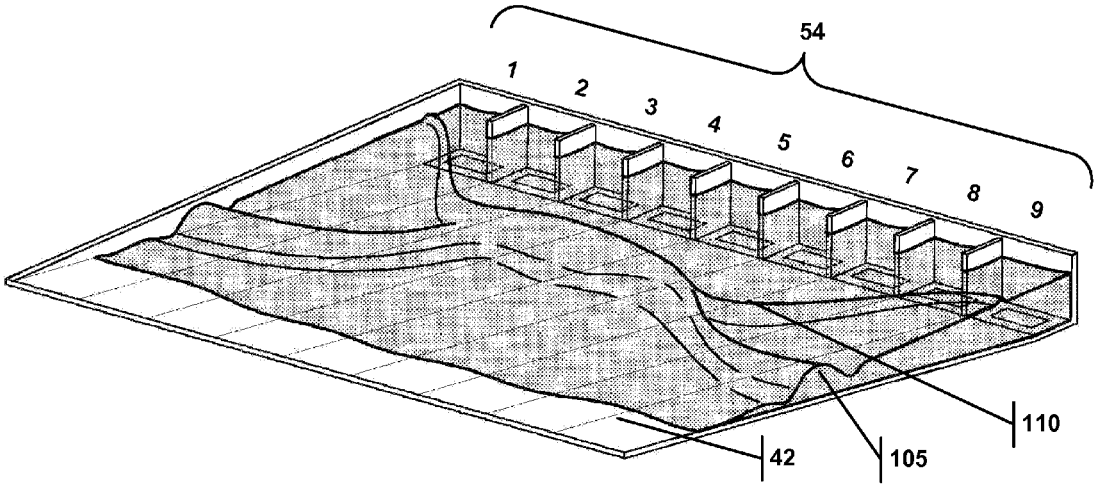

By way of example, the sequence may begin with chambers 54 on the edges of the pool to initiate the first wave segment 105 shown in FIG. 4. Chambers 1-2 and 8-9 actuate to begin the sequence. After the delay, a second wave segment 110 shown in FIG. 5 is generated in the sequence from center chambers between the edge segments (i.e., actuating chambers 3-7). The sequence continues to actuate the chambers to generate the first and second wave segment steps using the same delay. Therefore, the chambers operate in sequence, not all in unison.

Figure 8:
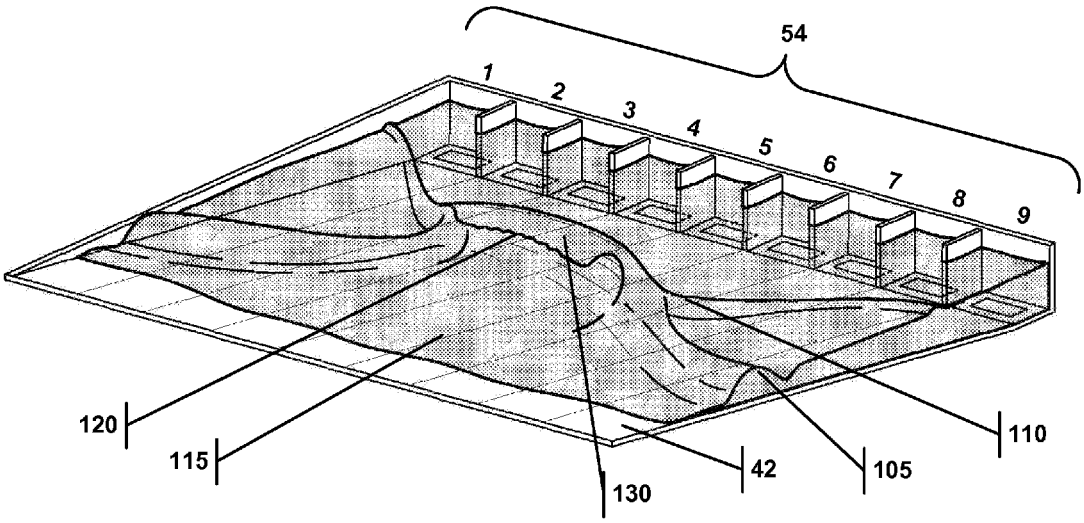
FIG. 8 is a perspective view of one example embodiment of a wave generator apparatus in a wave pool showing a considerably hollow barrel wave pitching away from the chambers that is created from the surge effect.

This sequence creates the surging effect 115 in the pool 50 that creates barreling waves that are more hollow, i.e., the barrel-shaped wave 120 preferred by wave riding enthusiasts, as seen in FIG. 8. In other embodiments, the sequence can begin with the inner chambers and continue with the outer chambers. For example, the sequence may begin with chambers 54 in the center of the pool initiating a first wave segment. Chambers 3-7 could actuate to begin the sequence. After the delay, a second wave segment may be generated in the sequence from both sides of the first, center wave segment. This could be chambers 1-2 and 8-9. After a delay of the same or similar length, a third wave segment could be generated in the sequence from chambers 3-7, for instance. In either example embodiment, the sequence may continue to actuate the chambers to generate the second and third wave segment steps using the same or similar delay. Also, each segment can be produced by a single chamber or two or more chambers, and the sequence can include more than two segments.

Moreover, when multiple adjacent chambers 54 actuate during each segment, there can be a secondary delay for each chamber. For instance, using the example sequence seen in FIGS. 4-5, during segment one, chambers 1-2 and 8-9 will all actuate using the primary delay, but with the secondary delay, they do not have to all actuate simultaneously. The secondary delay can actuate chambers 2 and 8 at a very slight delay after chambers 1 and 9 actuate. This secondary delay can be sequenced with any chambers within the primary delay sequence.

This type of sequencing can produce waves where the peak of the wave is substantially parallel to the chambers 54 and the beach 42 as it travels from the chambers 54 toward the beach 42. As seen in FIG. 7, the pattern 125 of the waves may resemble diamonds from a top view, and additional patterns may resemble diamonds linked at the vertices. The diamond effect is a result of the multiple wave segments generated in the sequence. This diamond pattern 125 creates a surging motion 115 in the entire pool 50 due to the sequence creating multiple waves 105, 110. The surging motion changes the breaking characteristics of the waves' natural flow. Indeed, the diamond pattern 125 reduces the depth of the water between successive waves because the previous wave will push the water away from the chambers 54 and towards the beach end 42. This causes waves to pitch away from the chambers 54 and create a considerably hollow barrel 120. Additionally, the surge 115 interacts with the wave 110 near the end of its break, which increases the wave height or amplitude, just as backwash interacts with waves in the ocean.

The fraction of delay between actuating each chamber 54 or set of chambers may be proportional to the chamber period. The chamber period is the time it takes a chamber to release the water and refill to the predetermined level. To refill, the chamber 54 may permit a fixed amount of water, if any, to reenter the chamber 54. When a chamber completes its period, the chamber is prepared to actuate again. To produce waves where the peak of the wave is substantially parallel to the chambers 54 and the beach 42 as it travels from the chambers 54 toward the beach 42, the controller operation may actuate each chamber 54 or set of chambers, using a delay, in sequenced fashion. For example, just after the first segment (first chamber or first set of chambers) completes the wave production portion of its period, the controller 62 may actuate the second segment (second chamber or second set of chambers), and it begins its period. This sequence may be repeated with each segment (chamber or set of chambers) using the same or similar delay, with the controller 62 operating the sequencing.

The controller 62 operates the sequenced fashion or sequencing, which comprises each chamber in the plurality actuating after a delay and completing a chamber period. The chamber period that is used as the delay by the controller 62 may be approximately one chamber period. The amount of delay in the sequence can be adjusted to as low as 0.10 of a chamber period to adjust the amplitude of the wave and the direction the peak may travel. The delay may be more than one chamber period. Also, the delay may vary between adjacent chambers.

When a chamber 54 or set of chambers has completed the process of pushing out the water or air needed to create a wave (for example, after half of the entire chamber period), the subsequent chamber or set of chambers can activate in the sequence. This allows the waves to continue to flow and create a surging effect. For example, in the example embodiment shown in FIGS. 4-5, each chamber period may be completed in two seconds. Therefore, the delay in the sequence would be set at one second, which is half of the chamber period. When each segment is completed, a new wave segment is then produced in sequence. While this example uses half of the chamber period as the delay in the sequence, similar sequences may be created with timing delays that are sequenced to actuate a chamber 54 or set of chambers during or soon after the previous chamber's or set of chambers' period.

The amplitude or height of the peak 130 of the wave 110 created generally depends on the size of the wave generating apparatus. However, the surge that is created using the present system increases the height of the wave over other designs because the surge 115 interacts with the wave 110 near the end of its break, as shown in FIG. 8, e.g. barreling perspective view following the sequence in FIG. 6. This interaction pushes the wave up to create a higher, bigger wave that tends to have desirable barreling characteristics.

The above description of the disclosed example embodiments is provided to enable any person skilled in the art to make or use the invention. Various modifications to these example embodiments will be readily apparent to those skilled in the art, and the generic principles described herein can be applied to other example embodiments without departing from the spirit or scope of the invention. Thus, it is to be understood that the description and drawings presented herein represent a presently preferred example embodiment of the invention and are therefore representative of the subject matter which is broadly contemplated by the present invention. It is further understood that the scope of the present invention fully encompasses other example embodiments that may become obvious to those skilled in the art and that the scope of the present invention is accordingly limited by nothing other than the appended claims.

The invention claimed is:

1. An aquatic sports amusement apparatus, comprising:

a pool which holds a body of water;

a plurality of wave-generating chambers that communicate with the body of water so as to release water into the pool, the chambers located adjacent to each other on an edge of the pool; and a controller connected to the chambers, wherein the connection is constructed to actuate the release of water from each chamber to create waves independently of the release of water from the other chambers;

wherein the controller operation of the chambers comprises the following steps:

a. actuating a first chamber or first set of chambers in the plurality to release water into the pool; and b. after a delay, actuating a second chamber or second set of chambers in the plurality to release water into the pool.

2. The apparatus of claim 1, wherein the waves comprise a peak defined as the highest water level in the pool and wherein the controller operation is further adapted to actuate the chambers such that the peak travels in a direction that is substantially perpendicular to the edge of the pool.

3. The apparatus of claim 1, wherein the controller operation of the chambers further comprises the following steps:

c. after a delay, actuating a third chamber or third set of chambers in the plurality to release water into the pool; and d. after a delay, actuating any subsequent chamber or subsequent set of chambers in the plurality to release water into the pool.

4. The apparatus of claim 3, wherein the delay in step (b) is of a different length than the delay in step (c).

5. The apparatus of claim 1, wherein the controller operation of the chambers further comprises the following steps:

c. after the first chamber or first set of chambers has released its water, refilling the first chamber or first set of chambers with water to a predetermined level, wherein the time to release the water and refill to the predetermine level is defined as the chamber period;

wherein the delay of step (b) is approximately one chamber period.

6. The apparatus of claim 5, wherein the plurality of chambers each comprise an air valve and a vent valve, wherein step (a) further comprises filing the chamber with air through the air valve, and wherein step (c) further comprises closing the air valve and opening the vent valve.

7. The apparatus of claim 6, wherein the air valve and vent valve comprise a single two way valve.

8. The apparatus of claim 1, wherein the controller operation of the chambers further comprises the following steps:

c. after the first chamber or first set of chambers has released its water, refilling the first chamber or first set of chambers with water to a predetermined level, wherein the time to release the water and refill to the predetermine level is defined as the chamber period;

wherein the delay of step (b) is approximately a fraction of the chamber period and the fraction is approximately 0.10-0.75.

9. The apparatus of claim 1, wherein the controller operation of the chambers further comprises the following steps:

c. after the first chamber or first set of chambers has released its water, refilling the first chamber or first set of chambers with water to a predetermined level, wherein the time to release the water and refill to the predetermine level is defined as the chamber period;

wherein the delay of step (b) is a fraction of the chamber period and the fraction is selected to adjust the amplitude of the wave peak.

10. The apparatus of claim 1, wherein the controller operation of the chambers may further comprise a secondary delay sequence, comprising the following steps:

c. actuating a first at least one chamber in a set of chambers to release water into the pool;

d. after a delay, actuating a second at least one chamber in a set of chambers to release water into the pool; and e. after a delay, actuating a third at least one chamber in a set of chambers to release water into the pool.

11. The apparatus of claim 10, wherein the controller operation of the chambers of the secondary delay sequence may further comprise the following steps:

after the first at least one chamber in each set of chambers has released its water, refilling the first at least one chamber with water to a predetermined level, wherein the time to release the water and refill to the predetermine level is defined as the chamber period;

wherein the delay of steps (b), (d) and (e) is approximately a fraction of the chamber period and the fraction is approximately 0.10-0.75.

12. The apparatus of claim 1, wherein the pool has a floor that is inclined.

13. A method of generating waves in a pool of water, comprising:

providing a pool which holds a body of water, the pool having:

a first and second end, two sides, and a floor;

a plurality of wave-generating chambers that communicate with the body of water so as to release water into the pool, the chambers located adjacent to each other on an edge of the pool;

a controller connected to the chambers, wherein the connection is constructed to actuate the release of water from each chamber to create waves independently of the release of water from the other chambers;

actuating a first chamber or first set of chambers in the plurality to release water into the pool; and after a delay, actuating a second chamber or second set of chambers in the plurality to release water into the pool.

14. The method of claim 13 further comprising:

after a delay, actuating a third chamber or third set of chambers in the plurality to release water into the pool.

15. The method of claim 14, wherein the delay before actuating the second chamber or second set of chambers is different than the delay before actuating the third chamber or third set of chambers.

16. The method of claim 13 further comprising:

after the first chamber or first set of chambers has released its water, refilling the first chamber or first set of chambers with water to a predetermined level, wherein the time to release the water and refill to the predetermine level is defined as the chamber period;

wherein the delay is approximately one chamber period.

17. The method of claim 13 further comprising:

after the first chamber or first set of chambers has released its water, refilling the first chamber or first set of chambers with water to a predetermined level, wherein the time to release the water and refill to the predetermine level is defined as the chamber period;

wherein the delay is approximately a fraction of the chamber period and the fraction is approximately 0.10-0.75.

18. The method of claim 17, wherein the waves comprise a peak defined as the highest water level in the pool and the fraction of the period is selected to adjust the amplitude of the peak.

19. The method of claim 17, wherein the waves comprise a peak defined as the highest water level in the pool and the fraction of the period is selected to adjust the direction of the peak.

* * * * *